US008929564B2

(12) United States Patent
Kikkeri

(10) Patent No.: US 8,929,564 B2
(45) Date of Patent: Jan. 6, 2015

(54) NOISE ADAPTIVE BEAMFORMING FOR MICROPHONE ARRAYS

(75) Inventor: Harshavardhana N. Kikkeri, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 760 days.

(21) Appl. No.: 13/039,576

(22) Filed: Mar. 3, 2011

(65) Prior Publication Data

US 2012/0224715 A1 Sep. 6, 2012

(51) Int. Cl.
*H04R 3/00* (2006.01)
*G10L 21/0216* (2013.01)

(52) U.S. Cl.
CPC ..... *H04R 3/005* (2013.01); *G10L 21/0216* (2013.01); *G10L 2021/02168* (2013.01); *G10L 2021/02166* (2013.01)
USPC ..... 381/92; 381/91; 381/94.1; 381/94.7; 381/95; 704/233

(58) Field of Classification Search
USPC ..... 381/92, 91, 94.1, 94.7, 95, 110, 122, 381/313; 704/226, 231, 233, 275
See application file for complete search history.

(56) References Cited

U.S. PATENT DOCUMENTS

| | | | | |
|---|---|---|---|---|
| 6,154,552 | A | 11/2000 | Koroljow | |
| 7,643,641 | B2 | 1/2010 | Haulick | |
| 2003/0138119 | A1 * | 7/2003 | Pocino et al. | 381/119 |
| 2003/0177007 | A1 | 9/2003 | Kanazawa | |
| 2007/0273585 | A1 | 11/2007 | Sarroukh | |
| 2008/0159559 | A1 | 7/2008 | Akagi | |
| 2008/0317259 | A1 | 12/2008 | Zhang | |
| 2009/0316929 | A1 | 12/2009 | Tashev | |

FOREIGN PATENT DOCUMENTS

| | | | |
|---|---|---|---|
| KR | 10-2003-0078218 | A * | 10/2003 |
| KR | 1020030078218 | A | 10/2003 |

OTHER PUBLICATIONS

Beamformer sensitivity to microphone manufacturing tolerances—Published Date: 2010 http://research.microsoft.com/pubs/76781/Tashev_BeamformerSensistivity_SAER_05.pdf.
A minimum distortion noise reduction algorithm with multiple microphones—Published Date: 2008 http://ieeexplore.ieee.org/stamp/stamp.jsp?arnumber=04441731.
Adaptive beamforming and soft missing data decoding for robust speech recognition in reverberant environments—Published Date: 2008 http://www.ee.uwa.edu.au/~roberto/research/papers/IS2008.pdf.
Multi-channel adaptive beamforming with source spectral and noise covariance matrix estimations—Published Date: 2005 http://iwaenc05.ele.tue.nl/proceedings/papers/S02-03.pdf.
International Search Report, Mailed: Sep. 25, 2012, Application No. PCT/US2012/027540, Filed Date: Mar. 2, 2012.

* cited by examiner

*Primary Examiner* — Paul S Kim
(74) *Attorney, Agent, or Firm* — Steve Wight; Judy Yee; Micky Minhas

(57) ABSTRACT

The subject disclosure is directed towards a noise adaptive beamformer that dynamically selects between microphone array channels, based upon noise energy floor levels that are measured when no actual signal (e.g., no speech) is present. When speech (or a similar desired signal) is detected, the beamformer selects which microphone signal to use in signal processing, e.g., corresponding to the lowest noise channel. Multiple channels may be selected, with their signals combined. The beamformer transitions back to the noise measurement phase when the actual signal is no longer detected, so that the beamformer dynamically adapts as noise levels change, including on a per-microphone basis, to account for microphone hardware differences, changing noise sources, and individual microphone deterioration.

20 Claims, 6 Drawing Sheets

NOISE ADAPTIVE BEAMFORMING FOR MICROPHONE ARRAYS

BACKGROUND

Microphone arrays capture the signals from multiple sensors and process those signals in order to improve the signal-to-noise ratio. In conventional beamforming, the general approach is to combine the signals from all sensors (channels). One typical use of beamforming is to provide the combined signals to a speech recognizer for use in speech recognition.

In practice, however this approach can actually degrade the overall performance, and indeed, sometimes performs worse than even a single microphone. In part this is because of individual hardware differences between the microphones, which can result in different microphones picking up different kinds and different amounts of noise. Another factor is that the noise sources may change dynamically. Still further, different microphones deteriorate differently, again leading to degraded performance.

SUMMARY

This Summary is provided to introduce a selection of representative concepts in a simplified form that are further described below in the Detailed Description. This Summary is not intended to identify key features or essential features of the claimed subject matter, nor is it intended to be used in any way that would limit the scope of the claimed subject matter.

Briefly, various aspects of the subject matter described herein are directed towards a technology by which an adaptive beamformer/selector chooses which channels/microphones of an microphone array to use based upon noise floor data determined for each channel. In one implementation, energy levels during times of no actual signal (e.g., no speech) are obtained, and once an actual signal is present a channel selector selects which channel or channels to use in signal processing based upon the noise floor data. The noise floor data is repeatedly measured, whereby the adaptive beamformer dynamically adapts to changes in the noise floor data over time.

In one implementation, the channel selector selects a single channel at any one time for use in the signal processing (e.g., speech recognition) and discards the other channels' signals. In another implementation, the channel selector selects one or more channels, with the signals from each selected channel combined for use in signal processing when two or more are selected.

In one aspect, a classifier determines when noise floor data is to be obtained in a noise measurement phase, and when a selection is to be made in a selection phase. The classifier may be based on a detected change in energy levels.

Other advantages may become apparent from the following detailed description when taken in conjunction with the drawings.

BRIEF DESCRIPTION OF THE DRAWINGS

The present invention is illustrated by way of example and not limited in the accompanying figures in which like reference numerals indicate similar elements and in which.

DETAILED DESCRIPTION

Various aspects of the technology described herein are generally directed towards discarding the microphone signals that degrade performance, by not using noisy signals. The noise adaptive beamforming technology described herein attempts to minimize the adverse effects resulting from microphone hardware differences, dynamically changing noise sources microphone deterioration and/or possibly other factors, resulting in signals that are good for speech recognition, for example, including initially and over a period of time as hardware degrades.

It should be understood that any of the examples herein are non-limiting. For one, while speech recognition is one useful application of the technology described herein, any sound processing application (e.g., directional amplification and/or noise suppression) may likewise benefit. As such, the present invention is not limited to any particular embodiments, aspects, concepts, structures, functionalities or examples described herein. Rather, any of the embodiments, aspects, concepts, structures, functionalities or examples described herein are non-limiting, and the present invention may be used various ways that provide benefits and advantages in sound processing and/or speech recognition in general.

Figure 1:
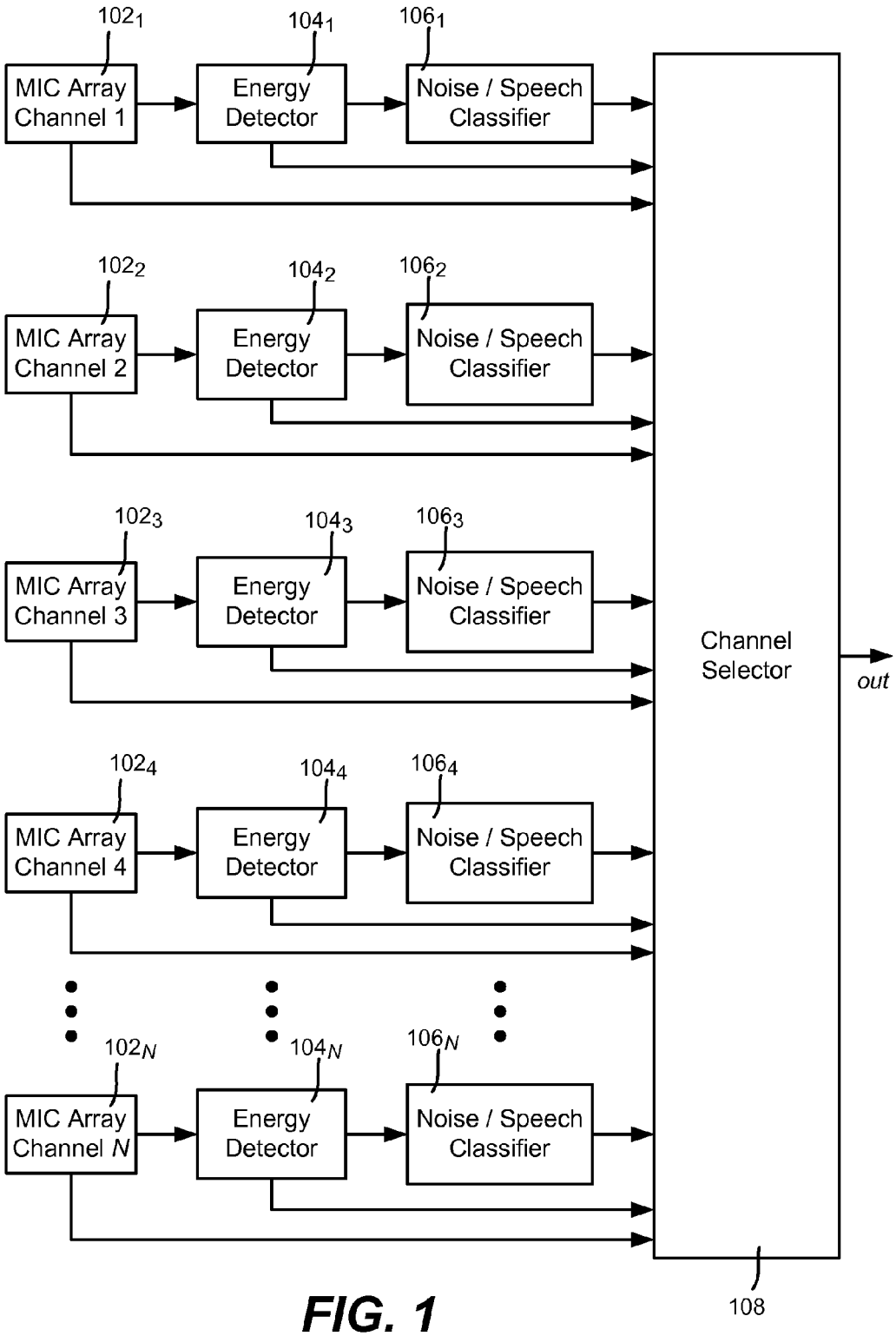
FIG. 1 is a block diagram representing example components of a noise adaptive beamformer/selector for microphone arrays.

FIG. 1 shows components of one example noise adaptive beamforming implementation. A plurality of microphones corresponding to microphone array channels $\mathbf{102}_1$-$\mathbf{102}_N$ each provide signals for selection and/or beamforming; it is understood that at least two such microphones, up to any practical number, may be present in a given array implementation.

Also, the microphones of the array need not be arranged symmetrically, and indeed, in one implementation, the microphones are arranged asymmetrically for various reasons. One application of the technology described herein is for use in a mobile robot, which may autonomously move around and thus be dynamically exposed to different noise sources while awaiting speech from a person.

Figure 2:
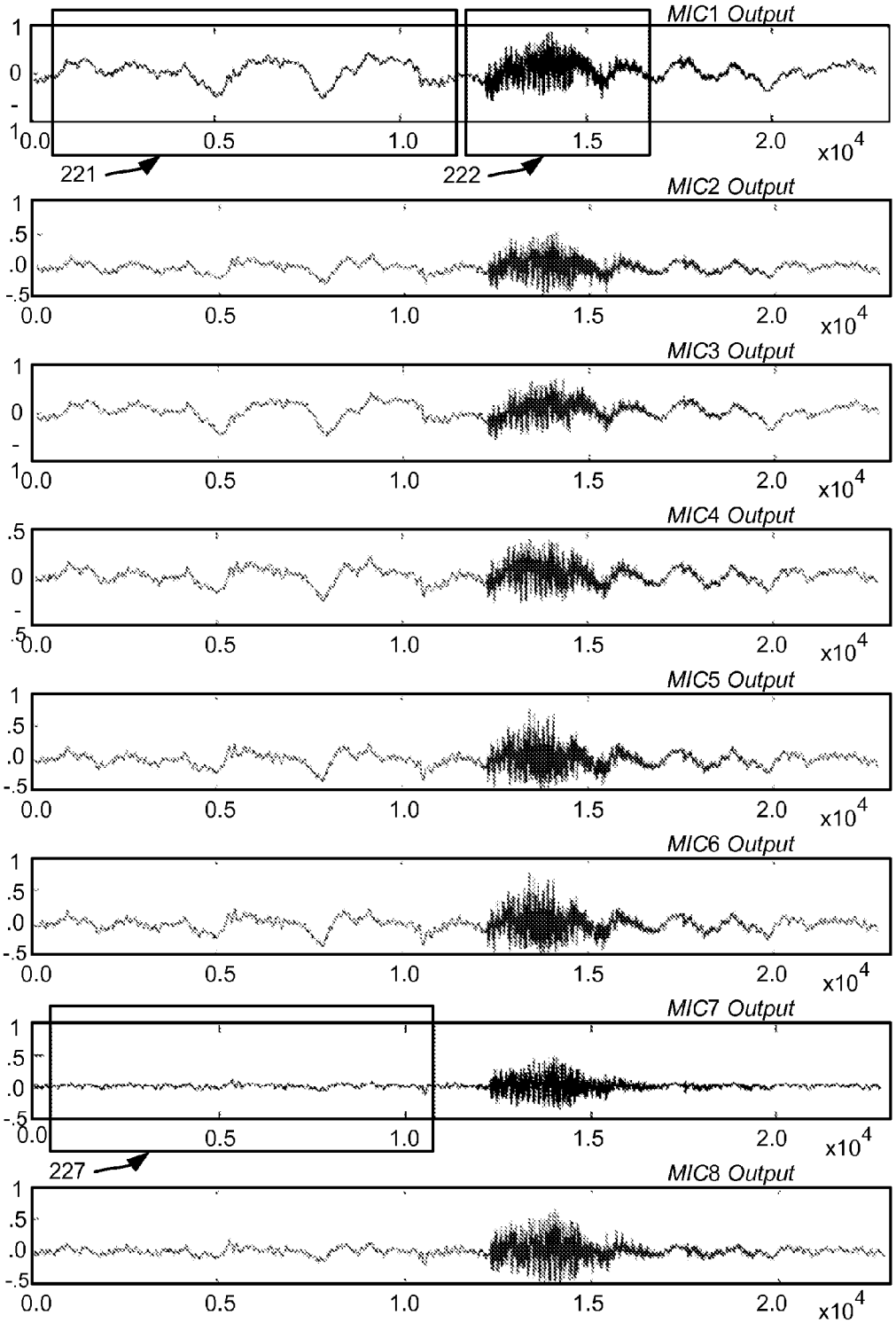
FIG. 2 is a representation of noise versus speech signals for the microphones of an example eight channel microphone array.

As represented by the energy detectors $\mathbf{104}_1$-$\mathbf{104}_N$ in FIG. 1, the noise adaptive beamforming technology described herein monitors the noise energy level in each microphone, including when there is no actual signal, that is, only noise. FIG. 2 is a representation of such energy levels of an example eight channel microphone array, in which the box 221 represents the "no actual signal" state for "MIC1" of the array. Initially, there is no true input signal, whereby the output of the microphones is only sensed noise. Note that the box 221 (as well as the other boxes) in FIG. 2 is not intended to represent an exact sampling frame or set of frames; (a typical sampling rate is 16K frames/second, for example).

When there is a signal, represented in FIG. 2 by the box 222, the energy increases, and the energy detectors $\mathbf{104}_1$-$\mathbf{104}_N$ provide an estimate indicative of the increase per channel. Noise/speech classifiers $\mathbf{106}_1$-$\mathbf{106}_N$ may be used to determine (e.g., based on a trained delta energy level or threshold energy level) whether the signal is noise or speech, and feed such information to a channel selector 108. Note that each classifier may include its own normalization, filtering, smoothing and/or other such techniques to make its determination, e.g., the energy may need to remain increased over some number of frames or otherwise match speech patterns to be considered speech, so as to eliminate brief noise energy spikes and the like that may occur from being considered speech. Note that it is also feasible to have a single noise-or-speech classifier for all channels, e.g., use only one of the channels for classification, or mix some or all of the audio channels for the purposes of classification (while maintaining them separately for selection purposes).

Based on the noise levels, when speech is detected, the channel selector 108 dynamically determines which (one or ones) of the microphone's signals is to be used for further processing, e.g., speech processing, and which signals are to be discarded. In the example of FIG. 1, the microphone MIC1 has a relatively large amount of noise when there is no signal, whereas the microphone MIC7 has the lowest amount of noise when there is no signal (box 227). Thus, when speech does occur (the approximate time corresponding to box 222 for each of the channels), the signal from the microphone MIC7 will likely be used, while the signal from the microphone MIC1 will likely be discarded.

In one implementation of noise adaptive beamforming, only the channel corresponding to the lowest noise signal is selected, e.g., in FIG. 2 only from microphone MIC7, because its noise floor when there is no signal is lower than that of the other microphones. In an alternative implementation, the channel selector 108 may select the signals from multiple channels, which are then combined into a combined signal for output. For example, the two lowest noise channels may be selected and combined. A threshold energy level or relative energy level data may be considered so as to not select more than the lowest noise channel if the next lowest is too noisy or relatively too noisy, and so on. As another alternative, each channel may be given a weight inversely related (in any suitable mathematical way) to that channel's noise and combined using a weighted combination.

In this manner, the use of noise floor tracking automatically eliminates (or substantially reduces) the adverse effect of noisy microphones because noisy microphones have higher levels of noise, and thus their signals are not used. This approach also eliminates the effect of microphones that are closer to noise sources in a given situation, e.g., near a television speaker. Similarly, as microphone hardware wears out or otherwise becomes damaged (some microphones go bad and regularly produce high level of noise), the noise adaptive beamformer automatically eliminates the effect of such microphones.

Figure 3:
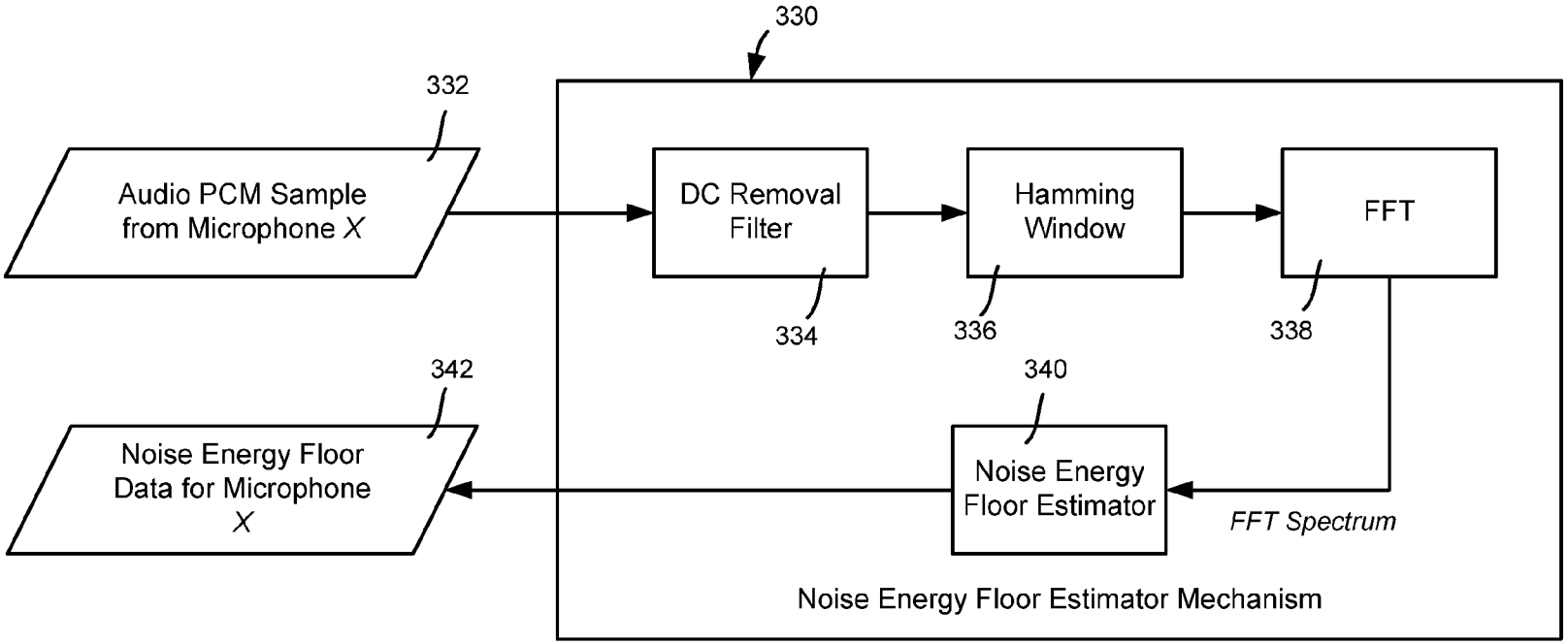
FIG. 3 is a block diagram representing a mechanism that estimates a noise energy floor for an input channel of a microphone array.

FIG. 3 is a block diagram representing an example noise energy floor estimator mechanism 330, such as for use in an energy detector for one of the channels. The incoming audio sample 332 for a given microphone X may be filtered (block 334) to remove any DC component from the signal, and then processed (e.g., smoothed) by a hamming window function 336 (or other such function) as is known before inputting the result to a fast Fourier transform (FFT) 338. Based on the FFT output, a noise energy floor estimator 340 computes noise energy data 342 (e.g., a representative value) in a generally known manner.

Figure 4:
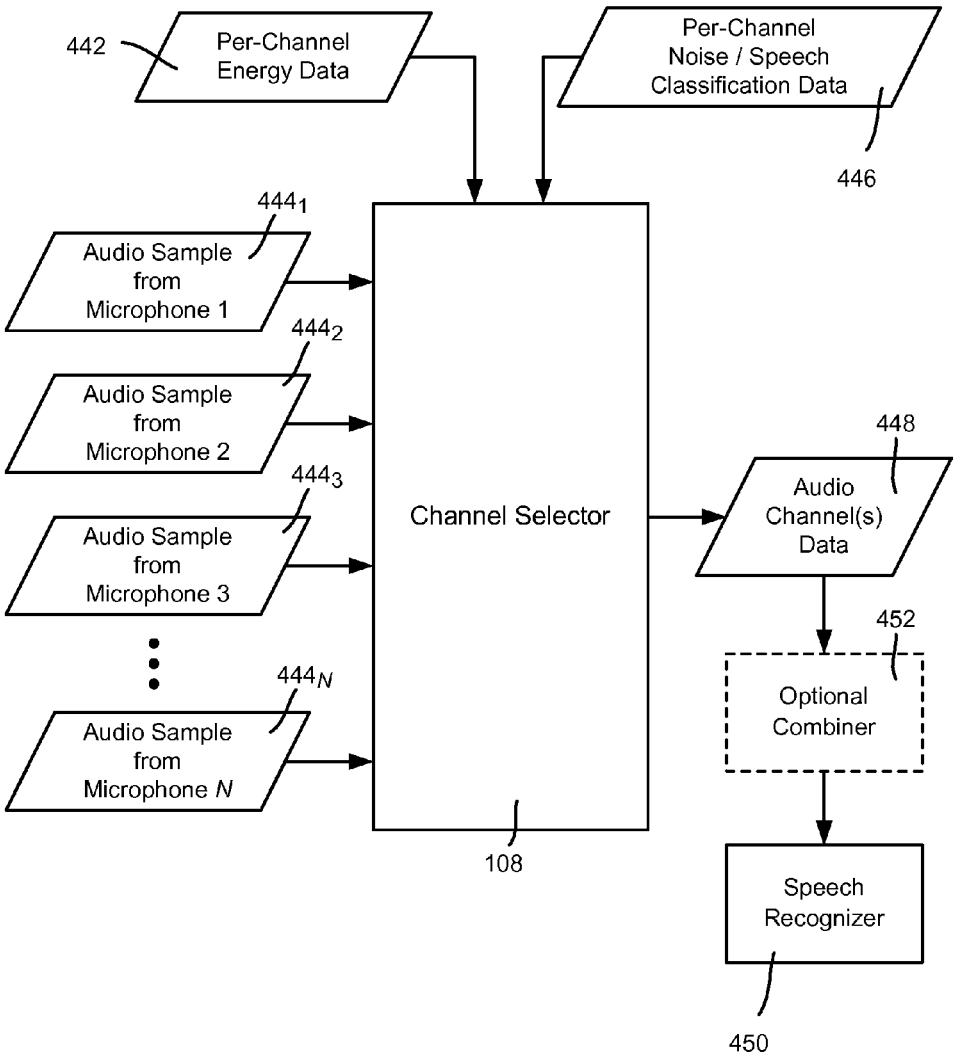
FIG. 4 is a block diagram representing how noise-based channel selection may be used by a noise adaptive beamformer/selector for adaptively providing signals to a speech recognizer.

As represented in FIG. 4, the noise energy data 442 for each channel is fed into the channel selector 108. Depending on the data 442 representing the noise energy level estimate from each microphone, when speech corresponding to audio samples $\mathbf{444}_1$-$\mathbf{444}_N$ is detected, as represented by the classification data 446, the channel selector 108 decides whether or not use the signal from each microphone. The channel selector 108 outputs the selected signal as selected audio channel data 448 for feeding to a speech recognizer 450. Note that as represented by block 452, if the channel selector 108 is configured to select more than one channel and does so, the signals from the multiple channels may be combined using any of various methods.

Figure 5:
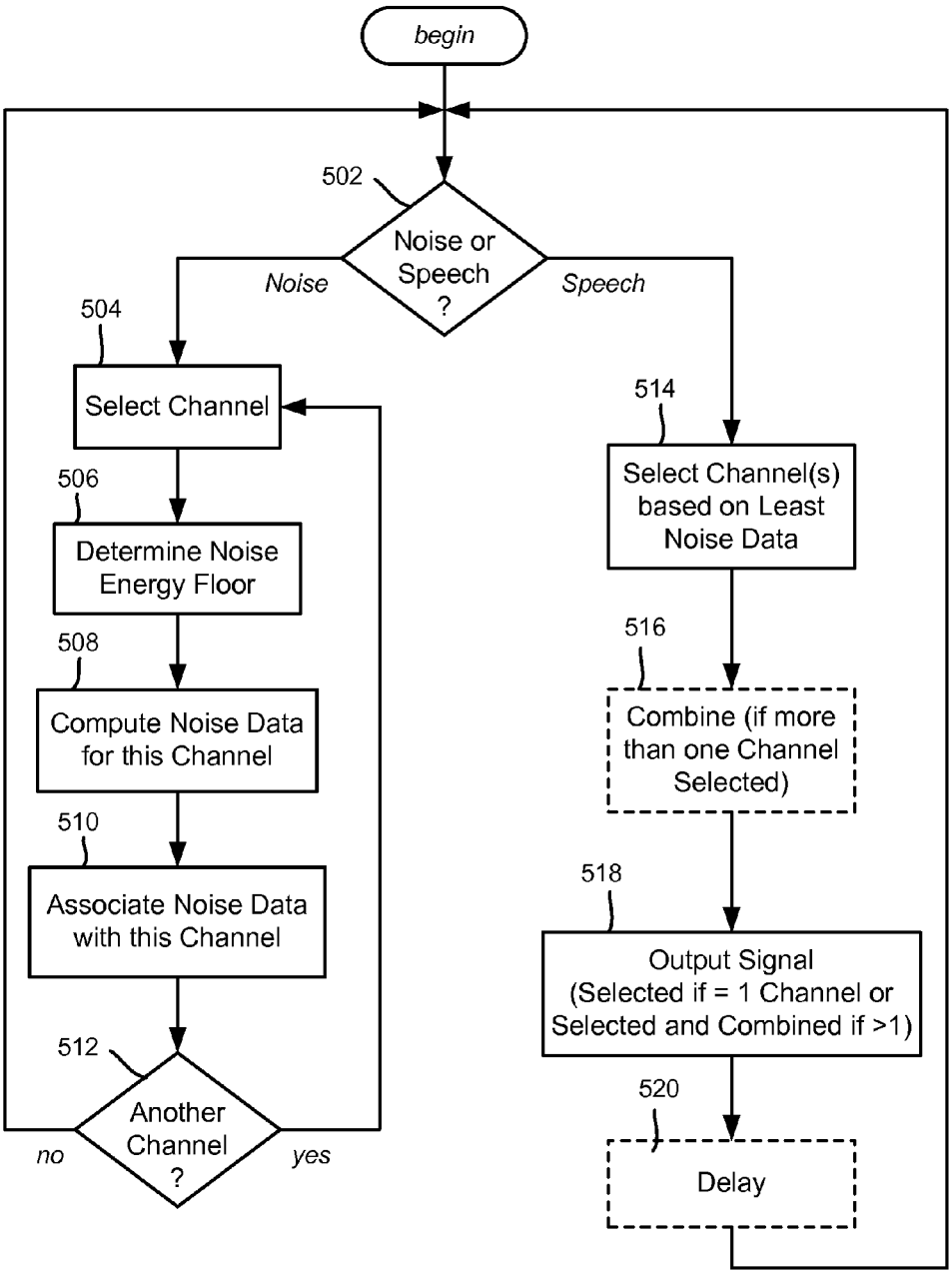
FIG. 5 is a flow diagram representing example steps in a noise measurement phase and a channel selection phase.

FIG. 5 summarizes various example operations related to channel selection and usage, beginning at step 502 where the classification is made as to whether the current input is noise or speech. If noise, step 504 selects a channel, and step 506 determines the noise energy floor for that channel, as described above. Step 508 represents computing the noise data for this channel, e.g., computing an average noise energy level over some number of frames, performing rounding, normalizing and/or the like so as to provide noise data that is expected by the channel selector. Step 510 associates the noise data with that channel, e.g., an identifier of that channel.

Step 512 repeats the noise measurement phase processing of steps 504-510 for each other channel. When the noise data for each channel is associated with a channel identity, the process returns to step 502 as described above.

At some subsequent time, speech is detected, whereby step 502 branches to step 514 to transition to a selection phase that selects the channel (or channels) that has the associated data indicative of the lowest noise level floor for use in further processing. In the event that more than one channel is selected at step 514, step 516 combines the signals from each channel. Step 518 outputs the selected channel's or combined channels' signal for use in further processing, e.g., speech recognition, before returning to step 502.

Note that shown in FIG. 5 is an optional delay at step 520, which may be used to delay before switching back to estimating noise after speech was detected. While the speech recognizer may be continuously receiving input including both speech and noise, switching microphones during a brief pause may lead to reduced recognition accuracy. For example, the speaker's inhalation or other natural noises during a brief pause may be detected as noise by the microphone that otherwise has the best noise results, and switching away from this microphone may provide speech input from another microphone that is noisier. Thus, by delaying, a speaker is given an opportunity to resume speaking instead of switching back to noise measurement during a brief pause. As an alternative (or in addition) to delaying, the channel selection operation may include smoothing, averaging and so forth to eliminate any such rapid microphone changes or the like. For example, if a microphone has had low noise relative to other microphones and thus has its signal selected for awhile, a sudden change in its noise floor energy may be ignored so as to not switch to another microphone because of a momentary glitch or the like.

As can be seen, described is a noise adaptive beamforming technology that uses noise floor levels to determine which of the microphones to use in beamforming. The noise adaptive beamforming technology updates this information dynamically, so as to dynamically adapt to a changing environment (in contrast to traditional beamforming).

Exemplary Computing Device

As mentioned, advantageously, the techniques described herein can be applied to any device. It can be understood, therefore, that handheld, portable and other computing devices and computing objects of all kinds including robots are contemplated for use in connection with the various embodiments. Accordingly, the below general purpose remote computer described below in FIG. 6 is but one example of a computing device.

Embodiments can partly be implemented via an operating system, for use by a developer of services for a device or object, and/or included within application software that operates to perform one or more functional aspects of the various embodiments described herein. Software may be described in the general context of computer executable instructions, such as program modules, being executed by one or more computers, such as client workstations, servers or other devices. Those skilled in the art will appreciate that computer systems have a variety of configurations and protocols that can be used to communicate data, and thus, no particular configuration or protocol is considered limiting.

Figure 6:
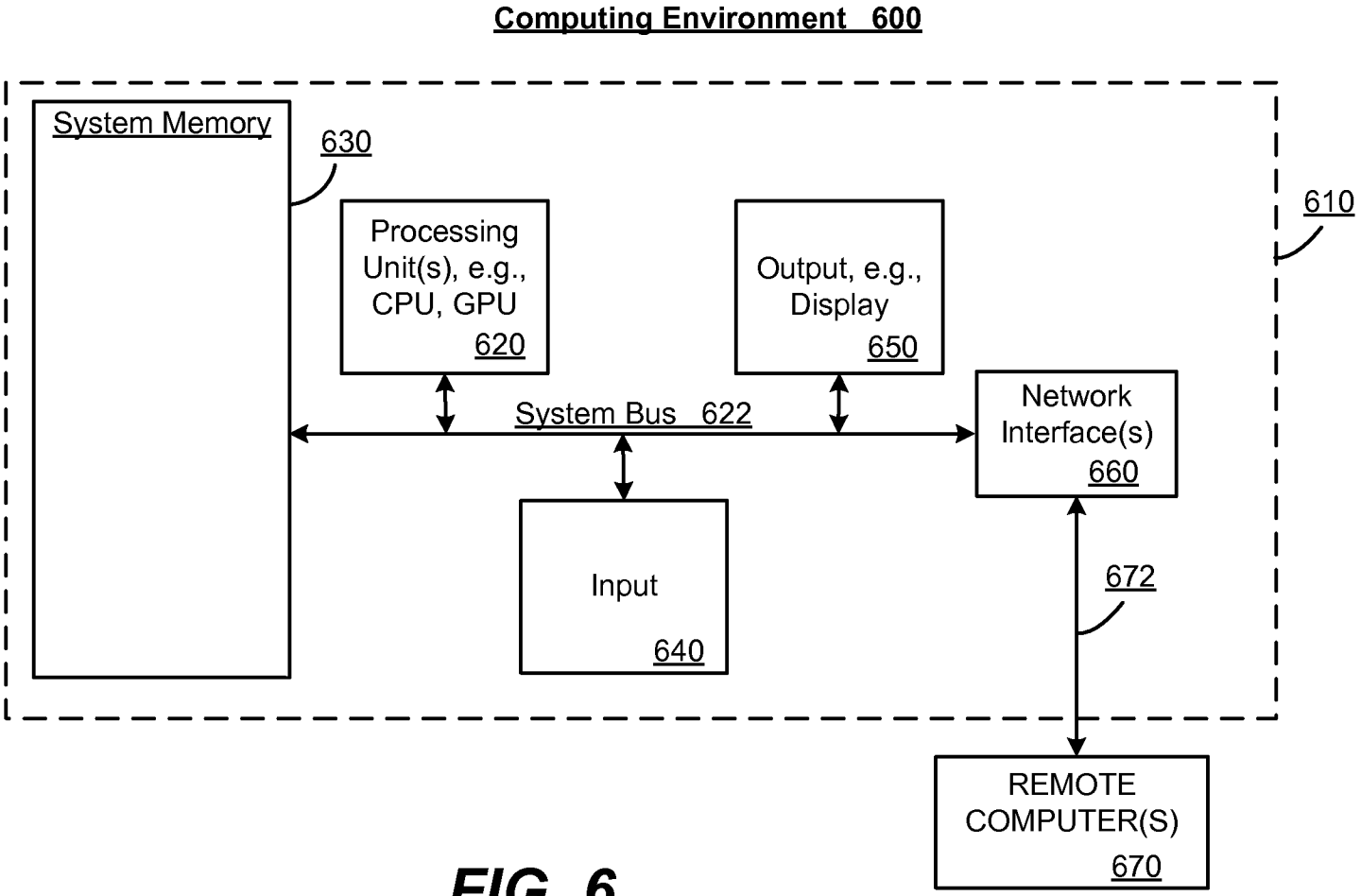
FIG. 6 is a block diagram representing an exemplary non-limiting computing system or operating environment in which one or more aspects of various embodiments described herein can be implemented.

FIG. 6 thus illustrates an example of a suitable computing system environment 600 in which one or aspects of the embodiments described herein can be implemented, although as made clear above, the computing system environment 600 is only one example of a suitable computing environment and is not intended to suggest any limitation as to scope of use or functionality. In addition, the computing system environment 600 is not intended to be interpreted as having any dependency relating to any one or combination of components illustrated in the exemplary computing system environment 600.

With reference to FIG. 6, an exemplary remote device for implementing one or more embodiments includes a general purpose computing device in the form of a computer 610. Components of computer 610 may include, but are not limited to, a processing unit 620, a system memory 630, and a system bus 622 that couples various system components including the system memory to the processing unit 620.

Computer 610 typically includes a variety of computer readable media and can be any available media that can be accessed by computer 610. The system memory 630 may include computer storage media in the form of volatile and/or nonvolatile memory such as read only memory (ROM) and/or random access memory (RAM). By way of example, and not limitation, system memory 630 may also include an operating system, application programs, other program modules, and program data.

A user can enter commands and information into the computer 610 through input devices 640. A monitor or other type of display device is also connected to the system bus 622 via an interface, such as output interface 650. In addition to a monitor, computers can also include other peripheral output devices such as speakers and a printer, which may be connected through output interface 650.

The computer 610 may operate in a networked or distributed environment using logical connections to one or more other remote computers, such as remote computer 670. The remote computer 670 may be a personal computer, a server, a router, a network PC, a peer device or other common network node, or any other remote media consumption or transmission device, and may include any or all of the elements described above relative to the computer 610. The logical connections depicted in FIG. 6 include a network 672, such local area network (LAN) or a wide area network (WAN), but may also include other networks/buses. Such networking environments are commonplace in homes, offices, enterprise-wide computer networks, intranets and the Internet.

As mentioned above, while exemplary embodiments have been described in connection with various computing devices and network architectures, the underlying concepts may be applied to any network system and any computing device or system in which it is desirable to improve efficiency of resource usage.

Also, there are multiple ways to implement the same or similar functionality, e.g., an appropriate API, tool kit, driver code, operating system, control, standalone or downloadable software object, etc. which enables applications and services to take advantage of the techniques provided herein. Thus, embodiments herein are contemplated from the standpoint of an API (or other software object), as well as from a software or hardware object that implements one or more embodiments as described herein. Thus, various embodiments described herein can have aspects that are wholly in hardware, partly in hardware and partly in software, as well as in software.

The word "exemplary" is used herein to mean serving as an example, instance, or illustration. For the avoidance of doubt, the subject matter disclosed herein is not limited by such examples. In addition, any aspect or design described herein as "exemplary" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used, for the avoidance of doubt, such terms are intended to be inclusive in a manner similar to the term "comprising" as an open transition word without precluding any additional or other elements when employed in a claim.

As mentioned, the various techniques described herein may be implemented in connection with hardware or software or, where appropriate, with a combination of both. As used herein, the terms "component," "module," "system" and the like are likewise intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on computer and the computer can be a component. One or more components may reside within a process and/or thread of execution and a component may be localized on one computer and/or distributed between two or more computers.

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it can be noted that one or more components may be combined into a single component providing aggregate functionality or divided into several separate sub-components, and that any one or more middle layers, such as a management layer, may be provided to communicatively couple to such sub-components in order to provide integrated functionality. Any components described herein may also interact with one or more other components not specifically described herein but generally known by those of skill in the art.

In view of the exemplary systems described herein, methodologies that may be implemented in accordance with the described subject matter can also be appreciated with reference to the flowcharts of the various figures. While for purposes of simplicity of explanation, the methodologies are shown and described as a series of blocks, it is to be understood and appreciated that the various embodiments are not limited by the order of the blocks, as some blocks may occur in different orders and/or concurrently with other blocks from what is depicted and described herein. Where non-sequential, or branched, flow is illustrated via flowchart, it can be appreciated that various other branches, flow paths, and orders of the blocks, may be implemented which achieve the same or a similar result. Moreover, some illustrated blocks are optional in implementing the methodologies described hereinafter.

CONCLUSION

While the invention is susceptible to various modifications and alternative constructions, certain illustrated embodiments thereof are shown in the drawings and have been described above in detail. It should be understood, however, that there is no intention to limit the invention to the specific forms disclosed, but on the contrary, the intention is to cover all modifications, alternative constructions, and equivalents falling within the spirit and scope of the invention.

In addition to the various embodiments described herein, it is to be understood that other similar embodiments can be used or modifications and additions can be made to the described embodiment(s) for performing the same or equivalent function of the corresponding embodiment(s) without deviating therefrom. Still further, multiple processing chips or multiple devices can share the performance of one or more functions described herein, and similarly, storage can be effected across a plurality of devices. Accordingly, the invention is not to be limited to any single embodiment, but rather is to be construed in breadth, spirit and scope in accordance with the appended claims.

What is claimed is:

1. In a computing environment, a system comprising:

a microphone array comprising a plurality of microphones corresponding to channels that each output signals;

a mechanism coupled to the microphone array and configured to determine noise floor data for each channel;

a channel selector configured to select which channel or channels to use in signal processing based upon the noise floor data for each channel, in which the channel selector adapts dynamically to changes in the noise floor data; and a classifier configured to determine when the noise floor data is to be obtained.

2. The system of claim 1 wherein the channel selector selects a single channel at any one time for use in the signal processing and discards the signals from each other channel during that time.

3. The system of claim 1 wherein the channel selector selects one or more channels at any one time for use in the signal processing, and further comprising, a mechanism configured to combine the signals from each selected channel when two or more are selected.

4. The system of claim 1 wherein the classifier is further configured to classify, based upon one or more input signals of the channels, whether the input signals correspond to noise or signals for signal processing.

5. The system of claim 1 wherein the signal processing corresponds to speech recognition.

6. The system of claim 1 wherein the mechanism that determines noise floor data for each channel comprises an energy detector.

7. The system of claim 6 wherein the energy detector includes a DC filter.

8. The system of claim 6 wherein the energy detector includes a smoothing function.

9. The system of claim 6 wherein the energy detector includes a fast Fourier transform for use in estimating the noise floor data.

10. The system of claim 1 wherein the microphone array is coupled to a robot.

11. In a computing environment, a method performed at least in part on at least one processor, comprising:

(a) determining noise data during a noise measurement phase, including noise data for each channel of a plurality of channels that correspond to microphones of a microphone array, wherein the noise measurement phase occurs at least in part during a time when there is no input signals for the plurality of channels;

(b) using the noise data to select which channel or channels to use for signal processing following the noise measurement phase; and (c) returning to step (a) to dynamically adapt channel selection as noise data changes over time.

12. The method of claim 11 wherein determining the noise data comprises computing data corresponding to an energy level for each channel.

13. The method of claim 11 further comprising, classifying, based upon one or more input signals of the channels, whether the input signals correspond to noise or signals for signal processing, for use in determining when to transition from step (a) to step (b), and for use in determining when to transition from step (b) to step (c).

14. The method of claim 11 wherein the signal processing corresponds to speech recognition, and further comprising, outputting signals corresponding to the selected channel or channels for use by a speech recognizer.

15. The method of claim 11 wherein using the noise data comprises selecting only a single channel based upon the noise data for that channel.

16. The method of claim 11 wherein using the noise data comprises selecting a plurality of channels based upon the noise data for those channels, and further comprising, combining the signals corresponding to those selected channels into a combined signal to use for the signal processing.

17. The method of claim 11 further comprising, delaying before returning to step (a).

18. One or more computer storage devices having computer-executable instructions, which when executed perform steps, comprising:

(a) determining noise data during a noise measurement phase, including obtaining a noise floor energy level for each channel of a plurality of channels that correspond to microphones of a microphone array, wherein the noise measurement phase occurs at least in part during a time when there is no input signals for the plurality of channels;

(b) detecting speech, and transitioning to a selection phase that uses the noise data to select which channel or channels to use for speech recognition;

(c) outputting a signal corresponding to the selected channel or channels for use for speech recognition; and (d) returning to step (a) to dynamically adapt channel selection as noise data changes over time.

19. The one or more computer storage devices of claim 18 wherein detecting speech comprises detecting a change from the noise floor energy level.

20. The one or more computer storage devices of claim 18 wherein a plurality of channels are selected at step (b), and having further computer-executable instructions comprising, combining the signals from the selected channels into a combined signal for outputting at step (c).

* * * * *